US005193558A

United States Patent [19]

Squatrito

[11] Patent Number: 5,193,558

[45] Date of Patent: Mar. 16, 1993

[54] SPIRAL ROD DEVICE FOR PERMANENT WAVE HAIRSTYLING

[75] Inventor: Joseph Squatrito, Staten Island, N.Y.

[73] Assignee: Hair Odyssey Cushion Wraps, Inc., New York, N.Y.

[21] Appl. No.: 906,530

[22] Filed: Jun. 29, 1992

[51] Int. Cl.[5] ..... A45D 2/08

[52] U.S. Cl. ..... 132/250; 132/248; 132/254; 132/268

[58] Field of Search ..... 132/245, 247, 248, 250, 132/254, 268

[56] References Cited

U.S. PATENT DOCUMENTS

| | | | |
|---|---|---|---|
| 2,265,492 | 12/1941 | Reiter | 132/250 |
| 2,720,882 | 10/1955 | Solomon | 132/254 |
| 2,732,845 | 1/1956 | Winkler | 132/250 |
| 2,747,584 | 5/1956 | Polykranas | 132/245 |
| 2,809,643 | 10/1957 | Schoendorf | 132/250 |
| 2,825,344 | 3/1958 | Lenois | 132/250 |
| 2,838,053 | 6/1958 | Zimmerman | 132/250 |
| 3,530,863 | 9/1970 | Foster et al. | 132/248 |
| 3,881,500 | 5/1975 | Shinbashi et al. | 132/252 |
| 4,108,183 | 8/1978 | Mauro | 132/250 |
| 4,270,555 | 6/1981 | Punte | 132/250 |

*Primary Examiner*—Gene Mancene
*Assistant Examiner*—Frank A. LaViola
*Attorney, Agent, or Firm*—Anthony J. Casella; Gerald E. Hespos

[57] ABSTRACT

A spiral rod device is provided to form permanent wave hairstyling curls along the entire length of the client's hair. The spiral rod device includes an elongated unitary solid rod with a plurality of spaced apart open slots extending along the length and cross-section of the elongated unitary solid rod, and a pair of end caps. The latter are used in conjunction with a rubber band for temporarily securely fastening the helically wound hair onto the spiral rod preparatory to the application of permanent wave lotion.

14 Claims, 2 Drawing Sheets

SPIRAL ROD DEVICE FOR PERMANENT WAVE HAIRSTYLING

BACKGROUND OF THE INVENTION

Permanent wave hairstyling typically refers to a multi-step process for imparting a longlasting pattern of waves or curls to hair. The multi-step permanent wave hairstyling process typically involves the initial washing of the hair and scalp with appropriate shampoo and a thorough rinsing of the hair and scalp with water to remove both the shampoo and oil and dirt lifted from the hair and scalp, by the sudsing action. A permanent wave lotion is then applied to the hair. In particular, permanent wave lotion is a commercially available caustic chemical that reacts with the hair to permanently accept a specific wave or curl orientation. Hair is first wound onto generally cylindrical rollers with the roller size, number, spatial orientation and rolling direction being selected by the hairdresser to achieve a particular desired hair style, after which the hair is saturated with the permanent wave lotion. The hair remains in this rolled and saturated condition for a period of time determined by the specific permanent wave lotion employed and the intended hair style. The hair is then flushed with water to remove excess permanent wave lotion and a neutralizer is applied to terminate the chemical reaction of the permanent wave lotion on the hair. The rollers are then removed from the hair, and the hair is rinsed, dried and styled in accordance with the pattern of waves and curls imparted by the above-described process.

For individuals with long hair, it is sometimes desired to form long helical curls, generally referred to as banana curls. For that purpose, a prior art hair curler consisted of an elongated, flexible plastic rod having a cylindrical socket element attached to one end thereof. By this construction, the elongated rod was capable of being bent so that the free end of the rod could be received and frictionally held within the socket end thereof for holding the hair wound about the rod in place preparatory to the application of the permanent wave lotion. More specifically, with the prior art plastic rod elongated, and proceeding from the bottom of the hair, the hairdresser rolls the client's hair onto the plastic rod in an overlapping helical fashion. When the hairdresser reaches the roots of the client's hair, the hairdresser bends the plastic rod about itself and frictionally fits the opposing ends of the plastic rod together in a generally circular formation. The hairdresser then applies the permanent wave hair lotion to the client's hair to form the permanent wave in the client's hair. After a proscribed interval of time, the hairdresser rinses the chemicals off of the client's hair, and then detaches the opposing ends of the plastic extrusion rod, thereby enabling the hairdresser to separate the hair from the plastic extrusion rod. At that time, the hair has a permanent wave or curl formation for a prolonged period of time.

The prior art plastic rod, however, has several disadvantages. First, it is very difficult to get a permanent curl formation near the root area of the client's head. Using the prior art plastic rod, the hairdresser is usually unable to form a strong base curl at the roots of the hair. Quite often, the plastic rod is unable to securely hold the client's hair upon the rod, since with the slightest movement of the client's head, the plastic extrusion rod quite often migrates away from the scalp area of the client's head and thus does not stay secured near the root area of the hair. Hence, a curl formation will not be formed at the root area of the client's head. Furthermore, it is often difficult for the hairdresser to properly apply the permanent wave lotion to the client's hair when using the prior art plastic rod. This is a result of the fact that the plastic extrusion rod is generally tubular, and as it hangs off the scalp area of the client's head, oriented in a circular formation, it is very difficult and cumbersome for the hairdresser to apply the required chemicals or to rinse the chemicals from the client's hair, especially in the root area. Furthermore, when the opposing ends of the prior art plastic extrusion rod are fitted together in a friction fit, quite often they become prematurely disengaged, thereby separating the client's hair from the plastic rod. Another principal disadvantage of the prior art plastic rod is that often when the opposing ends of the plastic extrusion rod are friction fitted together, a vacuum may be created in the socket connection between the two interconnected ends, and thus when the hairdresser attempts to pull the friction fitted ends apart, it may become a very difficult or cumbersome task. The vacuum develops in the plastic rod because the socket interconnection of the rod is subjected to an environment of continuous and wide ranging temperature changes. The temperature changes are caused by the continuous application of the caustic chemicals, the rinsing of the hair with cool water, and the application of the chemical neutralizer. Consequently, quite often a vacuum develops in the plastic rod and the hairdresser must ultimately cut, and hence destroy, the plastic rod in order to detach the friction fitted ends. Even if the hairdresser is successful in disengaging the friction fitted ends, the client is usually subjected to a considerable amount of pulling and tugging, which ultimately subjects the client to a considerable amount of discomfort or pain.

Accordingly, it has been found that the prior art plastic rod may be very difficult to work with, very cumbersome to work with, and may sometimes be quite expensive to use as the hairdresser might have to destroy the rod in order to remove it from the client's hair. Furthermore, the prior art rod may subject the client to a considerable amount of discomfort and pain.

Accordingly, it is an object of the subject invention to provide an improved hairstyling rod for permanent wave hairstyling of long hair.

Another object of the subject invention is to provide for a permanent hairstyling rod that is very efficient to work with, and which detaches easily from the hair.

A further object of the subject invention is to provide for a permanent wave hairstyling rod that enables a neater and more professional appearance when in use.

Still another object of the subject invention is to provide for a permanent wave hairstyling rod that achieves a tight curl of the hair near the root of the client's hair.

SUMMARY OF THE INVENTION

The subject invention provides a spiral rod device for permanent wave hairstyling of long hair, and which allows for a closer permanent hairstyling curl formation, especially near the scalp area of the head.

The subject spiral rod device include an elongated solid rod and two end caps. The spiral rod has opposed top and bottom ends, with both the top and bottom ends being formed with an annular expansion bead. Furthermore, the solid elongated rod includes stop flange members disposed in close proximity to both the top and bottom ends. Along the length of the elongated solid rod are a plurality of spaced apart slots which extend through the cross-section of the elongated rod. The latter is approximately three-eighths of an inch in diameter and approximately seven inches in length.

Each end cap is generally cylindrical and has an open end and an opposed closed end. Internally of each end cap, and adjacent to the closed end thereof, there is provided two spaced plastic stems which are rigidly connected to the inner surface of the closed end wall of the cap. Each cap is provided with an annular groove in its inner diameter, and the end wall of each cap includes a central opening. The plastic stems are positioned in close proximity to the central hole of each cap. Additionally, the subject spiral rod device is used with a conventional rubber band for holding the wound hair in place, as more fully described hereinafter.

In operation, first, the hairdresser inserts the rubber band through the central hole on the top end cap. The rubber band is then looped around one of the plastic stems adjacent to the closed end of the top end cap. Next, the hairdresser snap fits the top end cap with the top end of the solid elongated rod such that the top end cap engages the top end of the solid elongated rod, and thus connects on one end of the rubber band to the rod. The hairdresser, starting with the bottom of the client's hair and the bottom end of the elongated solid rod, then winds the client's hair in a helical formation, onto the elongated solid rod. At that time the other end of the rubber band is free. The hairdresser proceeds to wind the client's hair onto the elongated solid rod until the roots of the client's hair, near the scalp area of the client's head, are adjacent to the top end of the elongated solid rod. Then, the hairdresser inserts the free or unfastened end of the rubber band through the central hole in the bottom end cap, and the rubber band is looped around one of the stems adjacent to the closed end of the bottom end cap. The hairdresser then snaps on the bottom end cap onto the bottom end of the solid elongated rod, such that the annular expansion bead of the bottom end of the solid elongated rod snaps fit into the annular groove provided in the bottom end cap. The rubber band is thus extended along the length of the elongated solid rod and serves to securely fasten and maintain the client's hair onto the subject spiral rod device.

Once the client's hair is securely fastened to the subject invention's spiral rod device, the hairdresser applies the permanent wave hair lotion to the client's hair. The slots in the solid elongated rod allow passage of the lotion through the rod to evenly distribute the lotion along the strands of the client's hair. Additionally, the slots effectively reduce the weight of the solid elongated rod, so that when the client has a number of rods affixed to their head, the cling will not feel weighted down. After a proscribed period of time, the hair is then flushed with water to remove excess permanent wave lotion and a neutralizer is applied to terminate the chemical reaction of the permanent wave lotion on the client's hair. The hairdresser then readily disengages one end of the rubber band from the rod by merely unsnapping the bottom plastic end cap from the bottom end of the solid elongated rod, thereby enabling the hairdresser to easily separate the client's hair from the elongated rod.

Thereafter the solid elongated rod and plastic end cap of the subject invention are thoroughly cleaned and sterilized by the hairdresser in preparation for a future use. Thus, the subject invention spiral rod and cap may be used for numerous clients and applications. Most importantly, the readily removed bottom end cap assures multiple uses of the spiral rod device, as well as efficient and fast rolling and securing of the client's hair during a procedure.

DETAILED DESCRIPTION OF THE INVENTION

Figure 1:
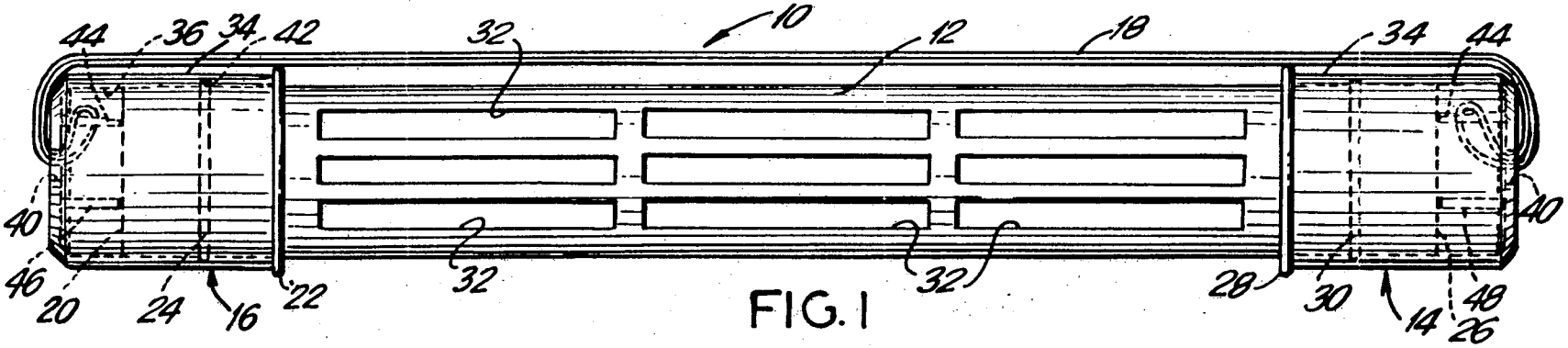
FIG. 1 is an elevational view of the spiral rod device of the subject invention.

FIG. 1 illustrates a preferred embodiment of the spiral rod device of the subject invention, that is generally identified by the reference numeral 10. Spiral rod device 10 basically includes a spiral rod 12, two end caps 14 and 16, and for maintaining the wound hair in place, a rubber band designated by the numeral 18. Hereinafter, for convenience, end cap 14 will be referred to as the bottom end cap, and the top end cap will be designated by numeral 16.

Figure 2:
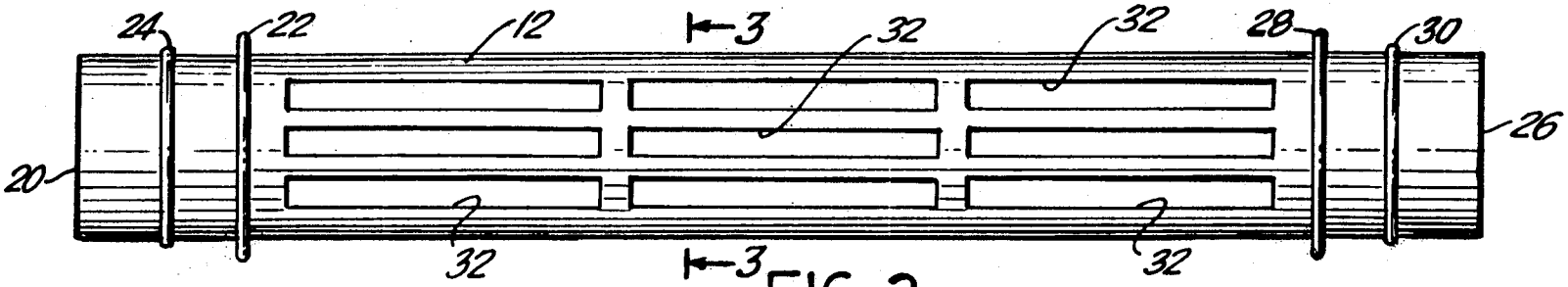
FIG. 2 is an elevational view of the spiral rod of the subject invention.
Figure 3:
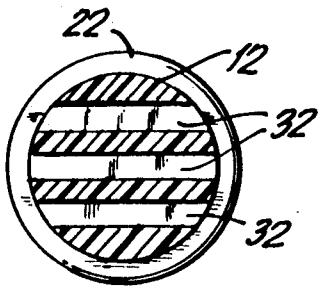
FIG. 3 is a cross-sectional view taken along line 3—3 in FIG. 2.

As shown in FIGS. 1 through 3, the spiral rod 12 is an elongated unitary solid rod, preferably made of a plastic material which is flexible. One end of the elongated unitary rod 12, includes a top end stop flange portion 22 and an annular expansion bead 24 intermediate the stop flange 22 and the end wall 20 of rod 12. Similarly, the other end of rod 12 includes a bottom end stop flange member 28, an annular expansion bead 30 and an end wall 26. Intermediate the stop flange members 22 and 28, the rod 12 is provided with a series of through slots, designated by the numeral 32. As shown in FIGS. 1 through 3, the through slots 32 are spaced apart and extend through the entire cross-section of the rod 12, as more clearly illustrated in FIG. 3. The purpose of the slots 32 is to enable the passage of permanent wave solution through the central portion of the rod 12 during a permanent wave procedure, and to also decrease the overall weight of the spiral rod device.

Figure 5:
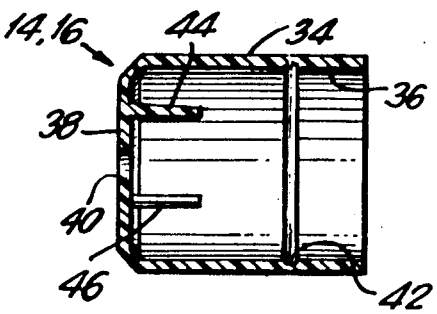
FIG. 5 is a cross-sectional view taken along line 5—5 in FIG. 4.
Figure 4:
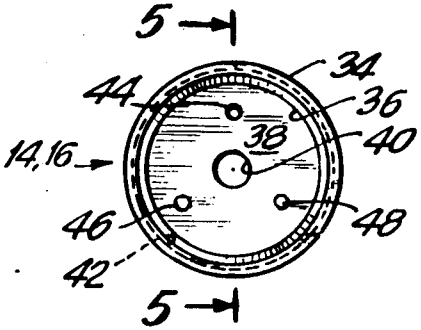
FIG. 4 is an end view of an end cap of the subject invention.

Turning to FIGS. 4 and 5, each end cap 14, 16 is of identical construction, and is generally cylindrical and includes an outer circumferential surface 34 and an inner circumferential surface 36, with one end of the end cap having a closed end wall 38, while the opposite end is open. The closed end wall 38, as shown in FIG. 4, includes a central opening 40. An annular groove 42 is provided on the inner circumferential surface 36 of the end cap, in close proximity to the open end. The annular groove 42 cooperates with the expansion bead 24, 30 for enabling snap fitting of the end cap onto the end of the plastic rod 12, to a final position wherein the open end of the end cap abuts against the bottom end stop flange member 22, 28 of the spiral rod 12, and the annular expansion bead 24, 30 is engaged in the annular groove 42 within the end cap. Additionally, a tapered plastic stem 44 is cantilevered from the interior of the end wall 38 and extends axially along the length of the cylindrical end cap, and is disposed adjacent the central opening 40. The tapered stem 44 is employed to hold an end of the rubber band 18 within the end cap 14,16 as more fully described hereinafter. Also cantilevered from the end wall 38 of each end cap are a pair of spaced pins 46, 48 which provide stability to the end cap when tension is applied thereto by the rubber band 18, as more fully described below. Of particular importance is the location of the pins 46, 48 relative to the tapered stem 44 for preventing rocking of the end cap from side-to-side on the spiral rod 12 because of the pressure of the extended rubber band. As shown in FIG. 4, the tapered stem 44 and the pins 46, 48 are disposed at approximately 120° intervals about the circumference of the annular end wall 38 of each cap.

The diameter of the inner circumferential surface 36 of each end cap 14, 16 and the diameter of the ends 20, 26 of the spiral rod 12 correspond in dimensions so as to achieve a desired snap fit relationship between each end cap and the end of the spiral rod 12. Similarly, the annular groove 42 of each end cap is dimensioned in accordance with the dimensions of the annular expansion bead 24, 30 of the spiral rod 12 so as to achieve the required snap-fit connection for maintaining the end cap on the end of the spiral rod 12 during use. Furthermore, the longitudinal dimension between each bottom end stop flange member 22, 28 and the respective end wall 20, 26 of the spiral rod 12 is approximately equal to the longitudinal dimension between the free end of the tapered stem 44 and the pins 46, 48 and the open end of the end cap, as shown in FIG. 1.

Figure 6:
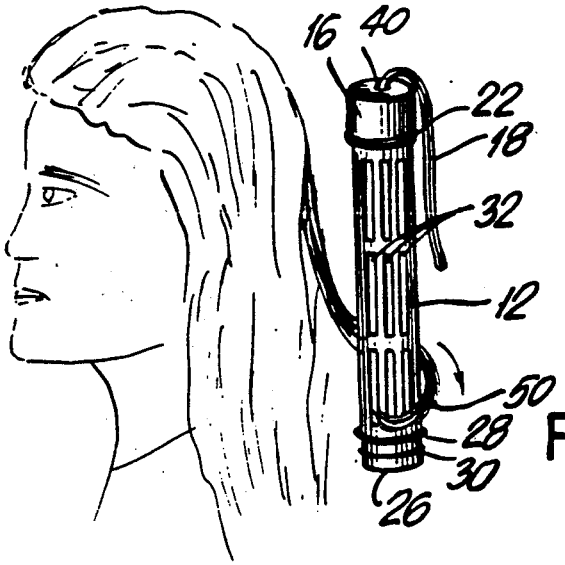
FIG. 6 is a perspective view of the spiral rod device at the beginning of a hair winding operation.
Figure 7:
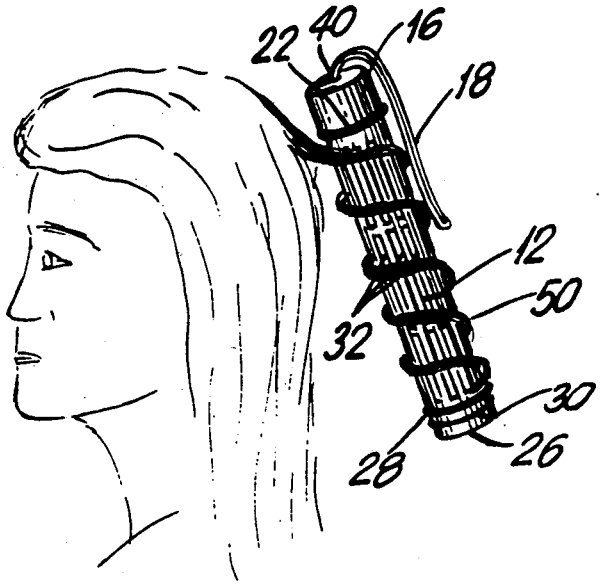
FIG. 7 is a perspective view of the spiral rod device with the hair fully wound onto the spiral rod.
Figure 8:
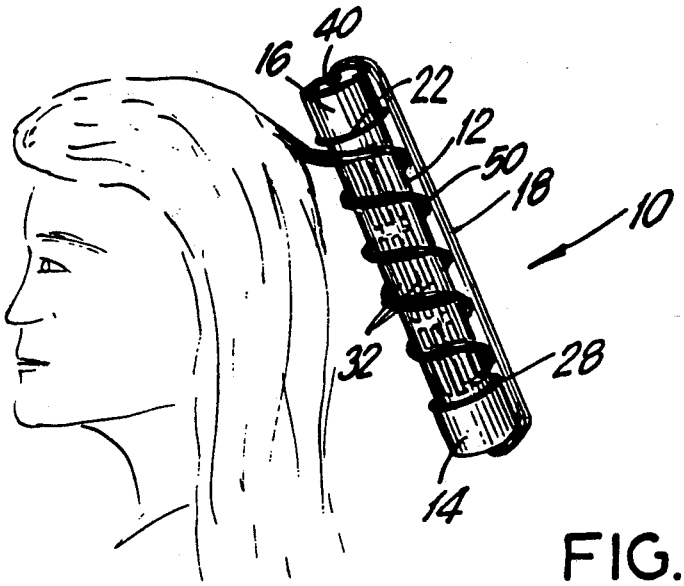
FIG. 8 is a perspective view of the spiral rod device of the subject invention with the hair fully would onto the device and with the rubber band connected to the bottom cap for temporarily affixing the hair onto the subject invention.

FIGS. 6, 7 and 8 illustrate use of the spiral rod device 10 of the subject invention. In preparation for use of the device, one end of the rubber band 18 is inserted through the central hole 40 of the top end cap 16 and is loosely secured around the tapered plastic stem 44. The top end cap 16 is then snap-fitted and connected to the one end of the spiral rod 12 until the open end of the top end cap 16 abuts the stop flange 22, at which time the distal ends of the tapered plastic stem 44 and the distal ends of stabilizing pins 46, 48 abut the end wall 20 of the spiral rod 12. At that time, the rubber band 18 is effectively locked into position within the top end cap 16, and the pins 46, 48 aid in preventing movement or rocking of the end cap 16 when force is applied to the rubber band 18.

Next, as illustrated in FIG. 7, the spiral rod 12 is positioned generally vertical and at an angle to the client's hair, designated by the numeral 50, with the bottom end 26 of the elongated rod 12 being located in close proximity to the free ends of the client's hair. The hairdresser then proceeds to wind a plurality of strands of the client's hair 50 in a helical manner about the elongated spiral rod 12, starting from the bottom end 26 and progressing towards the top end 20 of the spiral rod.

As illustrated in FIG. 7, the strands of hair of the client are wrapped in a helical fashion about the rod 12 until the roots of the client's hair 50 are adjacent the top end cap 16. Next, as shown in FIG. 8, the unfastened portion of the rubber band 18 is then inserted through the central hole 40 in the bottom end cap 14 and is loosely secured about the tapered stem 44. The bottom end cap 14 is then slipped over the bottom end 26 of the spiral rod 12 and snapped into place. The tapered stem 44 and the pins 46, 48 are positioned adjacent to the end wall 26 of the rod 12, thereby preventing dislodgement of the rubber band 18 from the bottom end cap 14. As illustrated in FIG. 8, the rubber band 18 expands along the entire length of the spiral rod device 10 and securely fastens the helically wound hair 50 of the client onto the spiral rod device 10 preparatory for the application of permanent wave lotion. Thereafter, permanent wave lotion is applied to the client's hair by various well known procedures, and as the permanent wave lotion is applied to the helically wound hair 50, it is capable of being evenly distributed by virtue of passage slots 32 disposed within the rod 12. Thereafter, the permanent wave hairstyling lotion is flushed from the client's hair after a proscribed period of time, and the bottom end cap 14 is readily disengaged from the spiral rod 12 by the application of an axial pulling force, thereby enabling the ready separation of the spiral rod device 10 from the treated client's hair.

While the invention has been described with respect to a preferred embodiment, it is apparent that various changes may be made without departing from the spirit and scope of the invention as defined by the appended claims. For example, in lieu of a snap-fit connection of the end caps, and especially the top end cap, the subject device may be constructed so that the top cap is threaded onto the rod for achieving a firmer connection to the rod.

I claim:

1. A spiral rod device for permanent wave hairstyling comprising:

an elongated rod having a top end and a bottom end, said rod including a top end stop flange disposed adjacent said top end and a bottom end stop flange member disposed adjacent said bottom end, said top end of said spiral rod being provided with an enlarged annular expansion bead, said rod having a plurality of spaced apart through slots disposed along the length of said rod intermediate said top end stop flange member and said bottom end stop flange member, said open slots extending through the cross-section of said rod;

an elongated top end cap having an open end and an opposed end wall, said end wall including a central hole therein, said top end cap being provided with an annular expansion groove in said inner diameter thereof and adapted for snap-fit interengagement with said annular expansion bead of said top end of said spiral rod, said top end cap further includes a stem connected to end wall and extending longitudinally of and within said top end cap, said top end cap being slidably receivable onto the top end of said spiral rod; and an elongated bottom end cap including an open end and an opposed end wall, said end wall including a central hole therein, said bottom end cap further including a stem connected to said end wall and extending longitudinally of and within said bottom end cap, said bottom end cap being connectable to said bottom end of said spiral rod whereby strands of hair helically wound about the rod may be maintained in place by inserting a rubber band through said central hole on said top end cap and extending the rubber band about said stem of said top end cap, while the opposed length of said rubber band is inserted through said central hole of said bottom cap end and secured around said stem on said bottom end cap, and wherein when said top end cap is detachably engaged with said top end of said spiral rod and said bottom end cap is detachably engaged with said bottom end of said spiral rod, thereafter said rubber band extends along the longitudinal axis of said spiral rod and maintains the hair in place on the spiral rod device.

2. A spiral rod device for permanent wave hairstyling as in claim 1, wherein the spiral rod, said top end cap, and said bottom end cap are constructed of a plastic material.

3. A spiral rod device for permanent wave hairstyling as in claim 1, wherein each said stem of the top end cap and the bottom end cap is tapered.

4. A spiral rod device for permanent wave hairstyling as in claim 3, wherein both said top end cap and said bottom end cap include stabilizing pins disposed therein and extending from the respective end wall, said stabilizing pins being spaced from the respective tapered stem.

5. A spiral rod device for permanent wave hairstyling as in claim 4, wherein the tapered stem and stabilizing pins in each said end cap are radially spaced at approximately 120° about the circumference of the respective end wall.

6. A spiral rod device for permanent wave hairstyling comprising:

an elongated rod having a top end and a bottom end, said rod including a top end stop flange disposed adjacent said top end and a bottom end stop flange member disposed adjacent said bottom end, said bottom end of said spiral rod being provided with an enlarged annular expansion bead, said rod having a plurality of spaced apart through slots disposed along the length of said rod intermediate said top end stop flange member and said bottom end stop flange member, said open slots extending through the cross-section of said rod;

an elongated top end cap having an open end and an opposed end wall, said end wall including a central hole therein, said top end cap further including a stem connected to said end wall and extending longitudinally of and within said top end cap, said top end cap being slidably receivable onto the top end of said spiral rod; and an elongated bottom end cap including an open end and an opposed end wall, said end wall including a central hole therein, said bottom end cap being provided with an annular extension groove in said inner diameter thereof and adapted for snap-fit interengagement with said annular expansion bead of said bottom end of said spiral rod, said bottom end cap further including a stem connected to said end wall and extending longitudinally of and within said bottom end cap, said bottom end cap being connectable to said bottom end of said spiral rod whereby strands of hair helically wound about the spiral rod may be maintained in place by inserting a rubber band through said central hole on said top end cap and extending the rubber band about said stem of said top end cap, while the opposed length of said rubber band is inserted through said central hole of said bottom cap end and secured around said stem on said bottom end cap, and wherein when said top end cap is detachably engaged with said top end of said spiral rod and said bottom end cap is detachably engaged with said bottom end of said spiral rod, thereafter said rubber band extends along the longitudinal axis of said spiral rod and maintains the hair in place on the spiral rod device.

7. A spiral rod device for permanent wave hairstyling as in claim 6 wherein the top end of the spiral rod is provided with an enlarged annular expansion bead, and said top end cap is provided with an annular expansion groove in said inner diameter thereof for snap-fit interengagement with said annular expansion bead of said top end of the spiral rod.

8. A spiral rod device for permanent wave hairstyling as in claim 6, wherein the spiral rod, said top end cap, and said bottom end cap are constructed of a plastic material.

9. A spiral rod device for permanent wave hairstyling as in claim 6, wherein each said stem of the top end cap and the bottom end cap is tapered.

10. A spiral rod device for permanent wave hairstyling as in claim 9, wherein both said top end cap and said bottom end cap include stabilizing pins disposed therein and extending from the respective end wall, said stabilizing pins being spaced from the respective tapered stem.

11. A spiral rod device for permanent wave hairstyling as in claim 10, wherein the tapered stem and stabilizing pins in each said end cap are radially spaced at approximately 120° about the circumference of the respective end wall.

12. A spiral rod device for permanent wave hairstyling comprising:

an elongated rod having a top end and a bottom end, said rod including a top end stop flange disposed adjacent said top end and a bottom end stop flange disposed adjacent said bottom end, said rod having a plurality of spaced apart through slots disposed along the length of said rod intermediate said top end stop flange member and said bottom end flange member, said open slots extending through the cross-section of said rod;

an elongated top end cap having an open end and an opposed end wall, said end wall including a central hole therein, said top end cap further including a tapered stem connected to said end wall and extending longitudinally of and within said top end cap, said top end cap being slidably receivable onto the top end of said spiral rod;

an elongated bottom end cap including an open end and an opposed end wall, said end wall including a central hole therein, said bottom end cap including a tapered stem connected to said end wall and extending longitudinally of and within said bottom end cap, said bottom end cap being slidably receivable onto the bottom end of said spiral rod;

both said top end cap and said bottom end cap including stabilizing pins disposed therein and extending from the respective end wall, said stabilizing pins being spaced from the tapered stems respectively within said top end cap and said bottom end cap, whereby strands of hair helically wound about the rod may be maintained in place by inserting a rubber band through said central hole of said top end cap and extending the rubber band about said tapered stem of said top end cap, while the opposed length of said rubber band is inserted through said central hole of said bottom cap end and secured around said tapered stem of said bottom end cap, and wherein said top end cap is detachably engaged with said top end of said spiral rod and said bottom end cap is detachably engaged with said bottom end of said spiral rod, such that said rubber band extends along the longitudinal axis of said spiral rod and maintains the hair in place on the spiral rod device.

13. A spiral rod device for permanent wave hairstyling as in claim 12, wherein the spiral rod, said top end cap, and said bottom end cap are constructed on a plastic material.

14. A spiral rod device for permanent wave hairstyling as in claim 12, wherein the tapered stem and stabilizing pins in each said end cap are radially spaced at approximately 120° about the circumference of the respective end wall.

* * * * *